United States Patent [19]

Knoble

[11] 4,187,449

[45] Feb. 5, 1980

[54] DISCHARGE LAMP OPERATING CIRCUIT

[75] Inventor: David W. Knoble, East Flat Rock, N.C.

[73] Assignee: General Electric Company, Schenectady, N.Y.

[21] Appl. No.: 904,059

[22] Filed: May 8, 1978

[51] Int. Cl.[2] ..... H05B 41/16

[52] U.S. Cl. ..... 315/205; 315/208; 315/239; 315/278; 363/155

[58] Field of Search ..... 315/137, 141, 142, 200 R, 315/205, 207, 208, 278, 239; 363/45, 64, 67, 153, 154, 155

[56] References Cited

U.S. PATENT DOCUMENTS

| | | | |
|---|---|---|---|
| 2,467,863 | 4/1949 | Short | 363/155 |
| 3,061,759 | 10/1962 | Spector | 315/278 X |
| 3,787,751 | 7/1974 | Farrow | 315/205 X |
| 4,084,217 | 4/1978 | Brandli et al. | 315/205 X |

*Primary Examiner*—Eugene R. LaRoche
*Attorney, Agent, or Firm*—Sidney Greenberg

[57] ABSTRACT

Circuit for providing low ripple DC power supply from a single-phase AC source without the use of a filter capacitor. The circuit comprises a high leakage reactance transformer with a primary winding and two secondary windings arranged with the secondary windings on opposite sides of the primary winding, a leading current circuit connected to one secondary winding and a lagging current circuit connected to the other secondary winding, and a three-phase full wave rectifier bridge connected to the leading and lagging current circuits to provide a low ripple DC power output. The DC power supply circuit is used with a pulse generating circuit to provide pulsed operation of a gaseous discharge lamp such as a high pressure sodium vapor lamp, and produces desirable relationship of lamp watts to lamp volts for improved lamp life and uniformity of illumination.

15 Claims, 4 Drawing Figures

DISCHARGE LAMP OPERATING CIRCUIT

The present invention relates to discharge lamp operating circuits, and more particularly concerns a direct current power supply circuit for such lamps.

It is an object of the invention to provide an improved DC power supply circuit for connection to an AC source.

A particular object of the invention is to provide a DC power supply which has low ripple characteristics.

Still another object of the invention is to provide a DC circuit of the above type for operation of gaseous discharge lamps.

A further object of the invention is to provide a DC power supply circuit of the above type for pulsed operation of gaseous discharge lamps, especially of high pressure type such as sodium or mercury vapor lamps.

Another object of the invention is to provide a DC lamp operating circuit of the above type which produces a desirable lamp wattage-lamp voltage relationship.

Other objects and advantages will become apparent from the following description and the appended claims.

With the above objects in view, the present invention in one of its aspects relates to a lamp operating circuit comprising, in combination, an AC source, a ballast transformer comprising a primary winding connected to the AC source, first and second seondary windings arranged on opposite sides of the primary winding magnetically coupled thereto, and magnetic shunts separating the primary winding from the respective secondary winding, a capacitor connected to one of the secondary windings forming therewith a leading current circuit, a lagging current circuit connected to the other secondary winding, rectifier bridge means connected to the leading and lagging current circuits, and means for connecting lamp means to the output of the rectifier bridge means, whereby DC current of low ripple content is produced for operation of the lamp means.

The invention will be better understood from the following description taken in conjunction with the accompanying drawings, in which.

Figure 1:
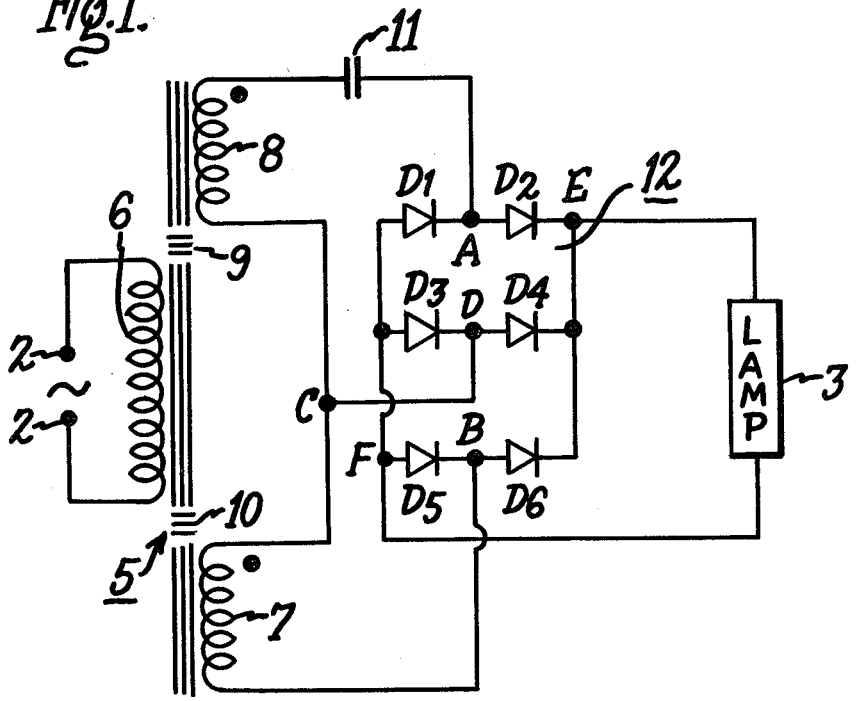
FIG. 1 is a circuit diagram of a DC lamp operating circuit in accordance with an embodiment of the invention.

Referring now to the drawings, and particularly to FIG. 1, there is shown a circuit diagram illustrating an embodiment of the DC operating circuit for operating a gaseous discharge lamp 3, which may be a fluorescent lamp or other low pressure lamp, but typically is a high intensity discharge lamp such as a mercury vapor or sodium vapor lamp. The circuit comprises terminals 2 of a source of alternating current, a ballast transformer 5 having a primary winding 6 connected to AC terminals 2 and two secondary winding 7 and 8 arranged on opposite sides of the primary winding inductively coupled thereto, with the windings separated by magnetic shunts 9 and 10 as shown. Thus, the secondary windings are each magnetically coupled to the primary winding but are not substantially magnetically coupled to each other. Transformer 5 is a high leakage reactance device for limiting the operating current in lamp 3, as well understood in the art, and the illustrated circuit is accordingly also referred to herein as a ballast circuit.

In accordance with the invention, capacitor 11 is connected to secondary winding 8 so as to form therewith a leading circuit, while a lagging current circuit is provided by secondary winding 7 in combination with magnetic shunt 10. The outputs of the described lead and lag circuits are connected as shown to input terminals A and B of three-phase full wave rectifier bridge 12 comprising diodes D1-D6, the lead and lag circuits also being electrically connected to each other with their common connection C connected to a third input terminal D of rectifier bridge 12. The output terminals E and F of bridge 12 are connected to lamp 3.

In the operation of the described circuit, ballast transformer 5 provides operating voltage for the lamp load while limiting the current therethrough, while rectifier bridge 12 converts the AC supply current to direct current for operating lamp 3. The leading current in the circuit comprising secondary winding 8 and capacitor 11 is about 120° out of phase with the lagging current in the circuit of secondary winding 7, and these currents are summed via rectifier bridge 12 to produce a low ripple current to lamp 3 and good power factor on-line current. As a result of the interconnection of secondary coils 7 and 8 at connection C as shown in the FIG. 1 embodiment, capacitor 11 discharges its energy near the zero of the line voltage, thereby enhancing the low ripple current effect.

The phase shift of the current in the lag circuit is determined by the output inductance of the lag secondary winding 7, and the phase shift of the current in the lead circuit is determined by a combination of the output inductance of the secondary winding 8 and capacitor 11. These phase shifts may be suitably adjusted, as well understood in the art, to provide the desired phase shift of about 120° between the lead and lag currents in these circuits. These adjustments also provide for adjustment of the magnitude of the DC supply with respect to the particular lamp load used.

The invention provides a low ripple DC power supply from a single phase AC source without the need for a filter capacitor such as employed in prior art circuits to obtain low ripple current. Advantages of the low ripple DC in the described circuit include the prevention of de-ionization and consequent de-ignition of the discharge lamp which may otherwise occur, permitting use of a smaller filter capacitor is such filtering is necessary, prolonging the life of such filter capacitors, and avoiding lamp flicker. A further advantage is that the current drawn from the AC source is substantially in phase with the source voltage, thus providing a high power factor, and obviating the need for a power factor correcting capacitor.

Where necessary or desirable, a filter capacitor (not shown) may be connected across the output terminals of rectifier bridge 12.

Figure 2:
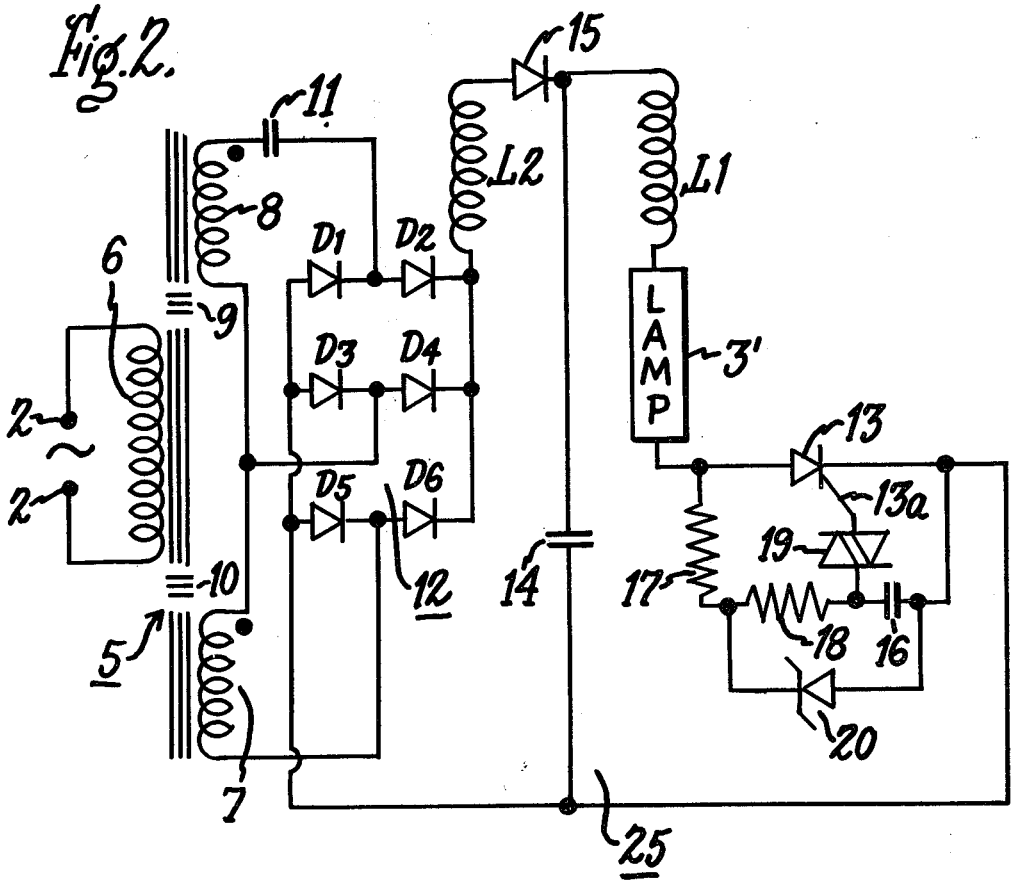
FIG. 2 is a circuit diagram of another embodiment of the invention for DC pulsed operation of the lamp.

FIG. 2 is a circuit diagram of a preferred embodiment of the invention wherein the DC supply circuit shown in FIG. 1 is employed in combination with a pulse generating circuit 25 for DC pulsed operation of lamp 3', which in this case is typically a high pressure sodium vapor discharge lamp, whereby the color properties of the lamp are improved. Such a pulse generating circuit is disclosed in copending application Ser. No. 743,566 - Neal, filed Nov. 22, 1976, now U.S. Pat. No. 4,092,565 issued May 30, 1978, and assigned to the same assignee as the present invention, and that disclosure is accordingly incorporated herein by reference. As there disclosed, the pulse generating circuit comprises inductor L2 connected in series with diode 15 and capacitor 14 across the DC supply, and in accordance with the present invention this circuit is connected across rectifier bridge 12. A second inductor L1, lamp 3' and a controlled unidirectional thyristor switch such as silicon controlled rectifier (SCR) 13 are connected in series across capacitor 14. The operation of SCR switch 13 is controlled by an RC timing circuit comprising, in the illustrated embodiment, capacitor 16 and resistors 17 and 18 connected across the SCR. A voltage breakdown device 19 constituted by a diac in the circuit shown is connected at one side to the junction of capacitor 16 and resistor 18 and at the other side to the control electrode (gate) 13*a* of SCR switch 13. Zener diode 20 is connected across capacitor 16 and resistor 18 of the timing circuit.

The inductance of inductor L2 is substantially higher than that of inductor L1, and in a typical circuit the L2 inductance would be about 10 times that of L1. However, the ratio may be in the range of about 2:1 to about 50:1 or higher while still obtaining satisfactory results. In general, the L2 inductance should be sufficiently high to ensure proper discharging of capacitor 14 through the discharge circuit and to provide for sufficient reversal of the capacitor charge to commutate the SCR as described below.

In the operation of the described circuit, capacitor 14, which serves as an energy metering device in the circuit, is charged by current flowing from rectifier bridge 12 through inductor L2 and diode 15. The charge on capacitor 14 reaches a positive voltage substantially higher than the supply voltage. When SCR 13 is triggered on by operation of the RC timing circuit, capacitor 14 discharges through inductor L1, lamp 3' and SCR 13, and subsequently this energy (minus the amount dissipated in the lamp) is returned to capacitor 14 but with the polarity of the voltage reversed, such that the upper electrode of capacitor 14 goes to a negative potential. This voltage reversal causes the SCR cathode voltage to be more positive than its anode voltage, and as a result commutation and turn-off of the SCR switch occurs. This negative potential is prevented from reversing again by SCR 13. Capacitor 14 is then again charged by supply current flowing through inductor L2 and diode 15 to a voltage higher than the supply voltage, and diode 15 serves to prevent the recharged energy on capacitor 14 from returning to the supply source. The circuit remains quiescent until the next pulse is provided by operation of the RC timing circuit. The latter circuit is adjusted to trigger SCR 13 to produce pulses of desired repetition rate for pulsing lamp 3' in the manner intended.

On the subsequent cycles, the positive voltage drop across SCR 13 increases to even higher levels, until an equilibrium potential is reached as a function of the total resistive losses in the circuit. This equilibrium potential can assume values greater than twice the supply voltage. In an illustrative case, with a supply voltage of about 180 volts, the equilibrium voltage across SCR 13 typically reaches about 450 volts during operation. Such high voltages, when imposed across lamp 3' during conduction of SCR 13, serve to ensure re-ionization and continued operation of the lamp, especially when the pulse repetition rate is relatively low.

The operation of the RC timing circuit is such that capacitor 16 is charged at a rate determined by the combination of resistors 17, 18 and capacitor 16. When the potential on capacitor 16 reaches the breakdown voltage of diac 19, capacitor discharges through the loop including SCR control electrode 13*a* and turns on SCR 13.

Zener diode 20 connected to the junction of resistors 17 and 18 of the RC timing circuit stabilizes the frequency of the triggering operation by establishing a fixed clamping voltage toward which capacitor 16 is charged. Resistors 17 and 18 arranged as shown constitute a voltage divider, so that the use of a smaller Zener diode is made possible.

Other details of the structure and operation of the pulse generating circuit will be found in the aforementioned Neal disclosure.

Where lamp 3' is of a type which requires relatively high voltage pulses in order to be ignited, such as high pressure sodium vapor lamps, a starting aid circuit of known or suitable type may be incorporated in the pulse generating circuit. Such a starting aid circuit is shown and described, for example, in the U.S. Pat. to Morais No. 4,045,709, assigned to the same assignee as the present invention.

While the described DC power supply circuit has been illustrated in conjunction with a particular pulse generating circuit, it will be understood that other types of pulse generating circuits, or non-pulsing circuits, may alternatively be used in combination therewith without departing from the scope of the invention.

Figure 3:
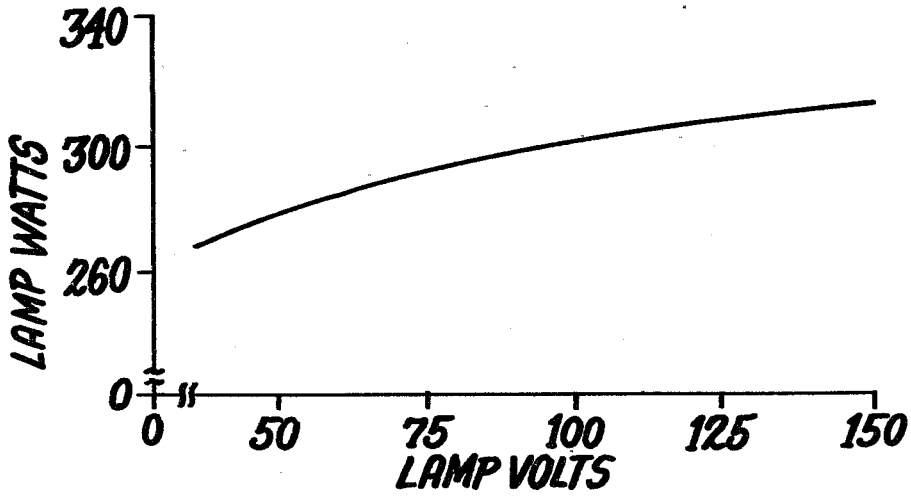
FIG. 3 is a graph showing the relationship of lamp volts and watts characterizing the circuit of FIG. 2.

FIG. 3 graphically illustrates the relationship of the lamp volts and lamp watts obtained from a circuit corresponding to that shown in FIG. 2 and incorporating a high pressure sodium vapor lamp. As seen in the graph, the curve representing this relationship indicates that the lamp watts remains relatively constant with the increase in the lamp volts which typically occurs over the operating life of such lamps, and as a result lamp life is prolonged and lamp illumination is relatively uniform during that period.

Figure 4:
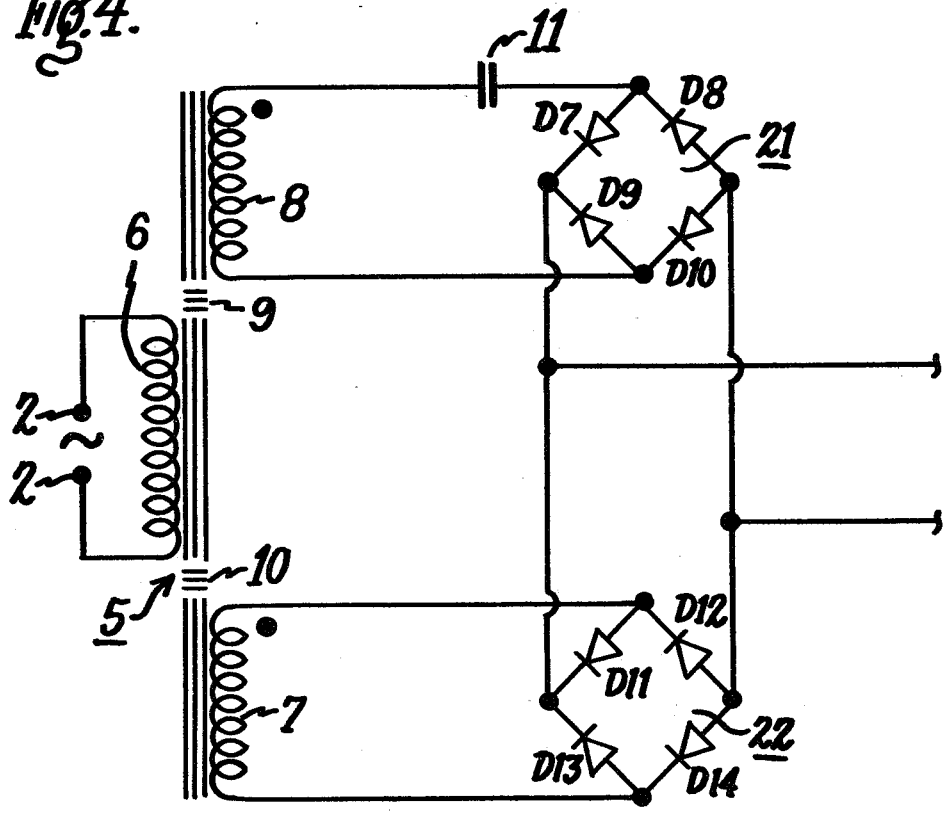
FIG. 4 is a circuit diagram of still another embodiment of the invention.

FIG. 4 shows a modification of the DC supply circuit shown in FIGS. 1 and 2. In the FIG. 4 version, the lag and lead circuits respectively incorporating secondary windings 7 and 8, instead of being directly connected with each other as shown in FIGS. 1 and 2, are respectively connected to separate single-phase full-wave rectifier bridges 21 and 22, the outputs of which are interconnected, as shown. In this embodiment, the phase shift between the lead and lag currents is preferably about 90°, and the DC output of the ballast circuit is of substantially constant voltage characteristic, which may be found preferable for use with certain types of lamps. As in the FIG. 1 circuit, a low ripple direct current is provided by the FIG. 4 circuit, with its attendant advantages as previously described.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. A lamp operating circuit comprising, in combination, an AC source, a ballast transformer comprising a primary winding connected to said AC source, first and second secondary windings arranged on opposite sides of said primary winding magnetically coupled thereto, and magnetic shunts separating said primary winding from the respective secondary windings, a capacitor connected to one of said secondary windings forming therewith a leading current circuit, the other secondary winding in combination with the magnetic shunt adjacent thereto forming a lagging current circuit, rectifier bridge means connected to said leading and lagging current circuits, and means for connecting lamp means to the output of said rectifier bridge means, whereby DC current of low ripple content is produced for operation of the lamp means.

2. A circuit as defined in claim 1, said lagging and leading current circuits being interconnected.

3. A circuit as defined in claim 2, wherein the currents in said leading and lagging current circuits are about 120° out of phase relative to each other.

4. A circuit as defined in claim 2, said rectifier bridge means comprising a three-phase full wave rectifier bridge.

5. A circuit as defined in claim 1, said rectifier bridge means comprising a pair of single-phase full wave rectifier bridges connected respectively to said leading and lagging current circuits.

6. A circuit as defined in claim 5, wherein the currents in said leading and lagging current circuits are approximately 90° out of phase relative to each other.

7. A circuit as defined in claim 1, and pulse generating circuit means connected between said rectifier bridge means and said lamp connecting means.

8. A circuit as defined in claim 1, and a gaseous discharge lamp connected to said lamp connecting means.

9. A circuit as defined in claim 7, and a high pressure sodium vapor discharge lamp connected to said lamp connecting means.

10. A direct current power supply circuit comprising, in combination, terminal means for connection to an AC source, a transformer comprising a primary winding connected to said terminal means, first and second secondary windings arranged on opposite sides of said primary winding magnetically coupled thereto, and magnetic shunts separating said primary winding from the respective secondary windings, a capacitor connected to one of said secondary windings forming therewith a leading current circuit, the other secondary winding in combination with the magnetic shunt adjacent thereto forming a lagging current circuit, rectifier bridge means connected to said leading and lagging current circuits, and means for connecting load means to the output of said rectifier bridge means, whereby DC current of low ripple content is produced for operation of the load means.

11. A supply circuit as defined in claim 10, said leading and lagging current circuits being interconnected.

12. A supply circuit as defined in claim 11, wherein the currents in said leading and lagging current circuits are approximately 120° out of phase relative to each other.

13. A supply circuit as defined in claim 11, said rectifier bridge means comprising a three-phase full wave rectifier bridge.

14. A supply current as defined in claim 10, said rectifier bridge means comprising a pair of single-phase full wave rectifier bridges connected respectively to said leading and lagging current circuits.

15. A supply circuit as defined in claim 14, wherein the currents in said leading and lagging current circuits are about 90° out of phase relative to each other.

* * * * *